US007654881B2

(12) United States Patent
Nakazato et al.

(10) Patent No.: US 7,654,881 B2
(45) Date of Patent: Feb. 2, 2010

(54) ACTION FIGURE WITH MOVABLE APPENDAGES

(75) Inventors: Makoto Nakazato, Redondo Beach, CA (US); Josiah To Sang Li, Monterey Park, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/761,260

(22) Filed: Jun. 11, 2007

(65) Prior Publication Data

US 2008/0045119 A1 Feb. 21, 2008

Related U.S. Application Data

(60) Provisional application No. 60/813,110, filed on Jun. 12, 2006.

(51) Int. Cl.
*A63H 13/06* (2006.01)
*A63H 13/00* (2006.01)

(52) U.S. Cl. ..... 446/334; 446/339; 446/390

(58) Field of Classification Search ..... 446/330, 446/334, 335, 336, 354, 376, 379–381, 340, 446/390

See application file for complete search history.

(56) References Cited

U.S. PATENT DOCUMENTS 3,147,566 A * 9/1964 Ong ..... 446/359
4,003,158 A * 1/1977 Wolf et al. ..... 446/334
4,206,564 A 6/1980 Ogawa
4,244,138 A 1/1981 Holahan et al.
4,601,672 A * 7/1986 Cook et al. ..... 446/330
4,623,318 A * 11/1986 Tsiknopoulos et al. ..... 446/330
4,657,518 A * 4/1987 Kelley et al. ..... 446/354
4,738,649 A * 4/1988 Delli Bovi et al. ..... 446/336
4,750,895 A 6/1988 Shinohara et al.
4,750,900 A * 6/1988 Hart ..... 446/308
4,934,981 A 6/1990 Stulbach
5,019,007 A 5/1991 Miller
5,163,861 A 11/1992 Van Ruymbeck
5,290,185 A * 3/1994 Murakami ..... 446/334
5,580,296 A 12/1996 Chow
5,601,462 A 2/1997 Harlow
5,941,755 A 8/1999 Daneilian
6,012,962 A 1/2000 Arriola
6,022,263 A * 2/2000 Liu et al. ..... 446/379
6,093,078 A * 7/2000 Cook ..... 446/354
6,152,799 A 11/2000 Arriola
6,224,456 B1 * 5/2001 Wittenberg ..... 446/330
6,247,990 B1 6/2001 Moorhouse
6,454,626 B1 * 9/2002 An ..... 446/330
6,722,939 B2 * 4/2004 An ..... 446/330
6,726,523 B2 4/2004 Baker et al.
6,729,933 B2 5/2004 Hoeting et al.

* cited by examiner

*Primary Examiner*—Kien T Nguyen
(74) *Attorney, Agent, or Firm*—Kolisch Hartwell, P.C.

(57) ABSTRACT

An action figure is provided having movable appendages. The action figure includes a body having a plurality of appendages including a first appendage configured to rotate about a first axis and a second appendage configured to rotate about a second axis. The action figure further includes a first movement assembly configured to drive movement of the first appendage and a second movement assembly configured to drive movement of the second appendage. At least one of the first and second movement assemblies is configured to delay movement of a corresponding appendage.

20 Claims, 4 Drawing Sheets

ACTION FIGURE WITH MOVABLE APPENDAGES

CROSS-REFERENCE TO RELATED APPLICATIONS

This application claims priority under 35 U.S.C. 119(e) to U.S. Provisional Patent Application No. 60/813,110 entitled "ACTION FIGURE WITH MOVABLE ACCESSORY," filed Jun. 12, 2006, the disclosure of which is incorporated herein by reference.

BACKGROUND

Children enjoy a variety of action figures that can be manipulated to simulate real life activities, such as martial arts. Children also typically prefer to play with toys that have several play options. It is therefore desirable to provide children with toys that both simulate activities the children are not yet able to participate in themselves while stimulating their imaginations with several play options. One way of increasing the available play options is to provide toys with movable components.

Examples of action figures having movable parts and/or accessories are found in U.S. Pat. Nos. 4,206,564, 4,244,138, 4,601,672, 4,750,895, 4,750,900, 4,934,981, 5,019,007, 5,163,861, 5,580,296, 5,601,462, 5,941,755, 6,012,962, 6,152,799, 6,247,990, 6,726,523, and 6,729,933, the disclosures of which are incorporated herein by reference.

SUMMARY

The present disclosure relates generally to a movable action figure. More specifically, it relates to an action figure having other movable components, such as a weapon or other accessory.

The advantages of the present invention will be understood more readily after a consideration of the drawings and the Detailed Description.

DETAILED DESCRIPTION

Figure 1:
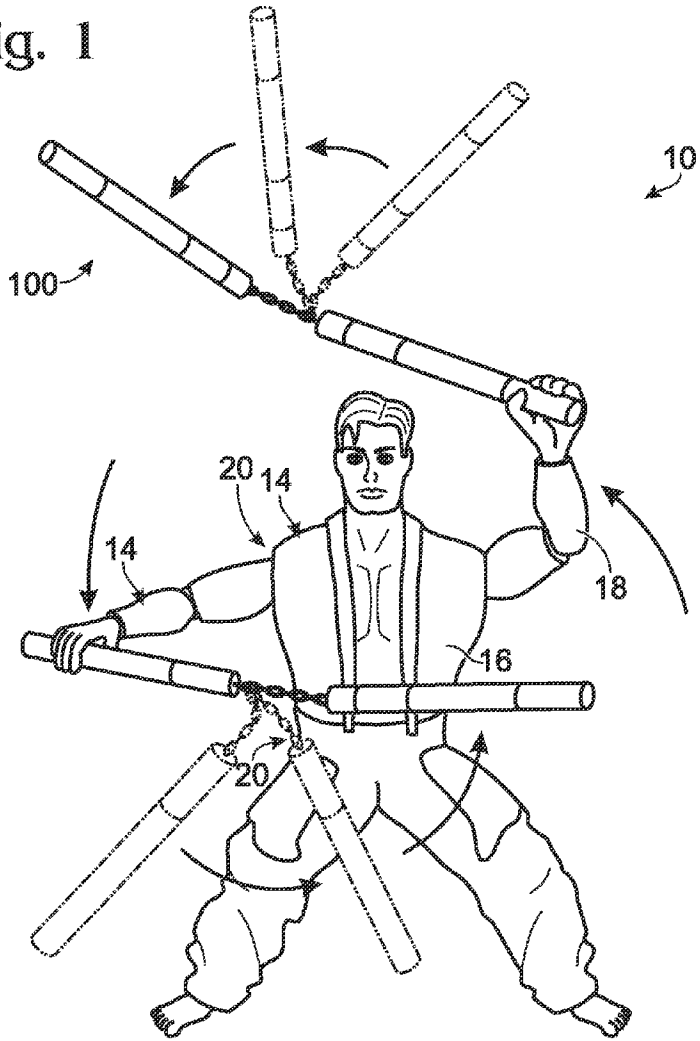
FIG. 1 illustrates an exemplary movable action figure and associated accessory.

An exemplary toy, such as an action figure, 10 is shown in FIG. 1. The action figure may include several movable components. For example the action figure may include a body 12 having several body segments 14, such as a central segment or torso 16 and one or more appendages 18. The body segments may be integrally formed or may be coupled together by joints 20. As shown in FIG. 1, the toy may include movable segments, such as a torso, a pelvis, a head, arms, and legs, depending on the form of the action figure and the desired play options.

To increase play value of toy 10, the toy may include one or more accessories 100, such as a weapon. The action figure and accessory may be permanently or removably coupled to one another. For example, the action figure may be joined to the accessory using glue, tapes, hook-and-loop closure material, snaps, and the like, or may be integrally formed with the accessory. In some configurations, the accessories and action figures are configured to be used interchangeably with other versions of accessories and action figures. In the examples shown, the action figure is associated with a martial arts style weapon. As illustrated, the accessory may be a toy nunchaku, also known as numchucks, which are a pair of sticks joined by a chain or cord and used as a weapon.

Figure 2:
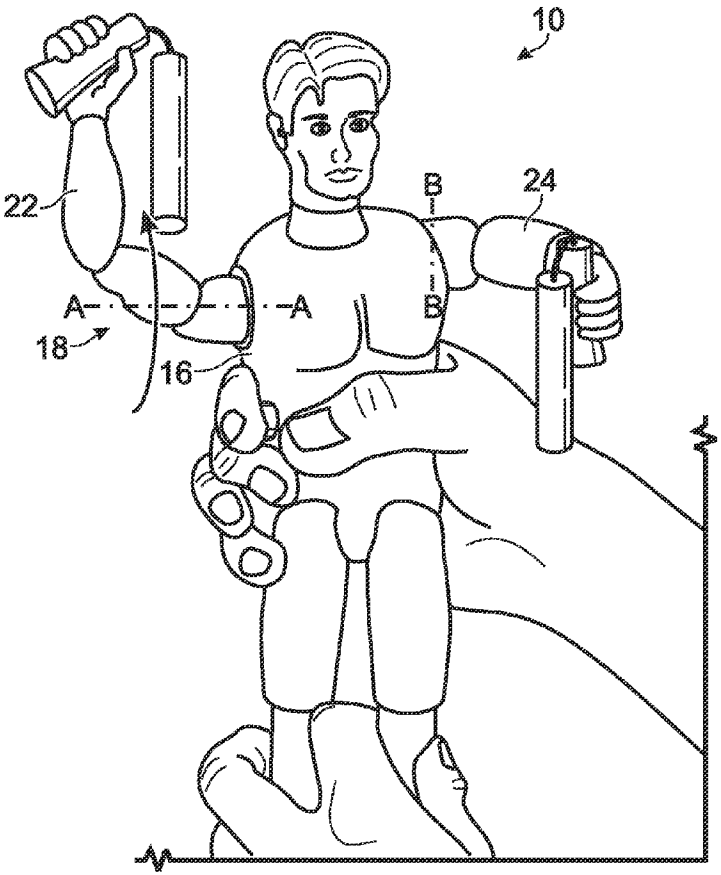
FIG. 2 illustrates actuation of an exemplary action figure showing movement of a first appendage about a first axis.
Figure 3:
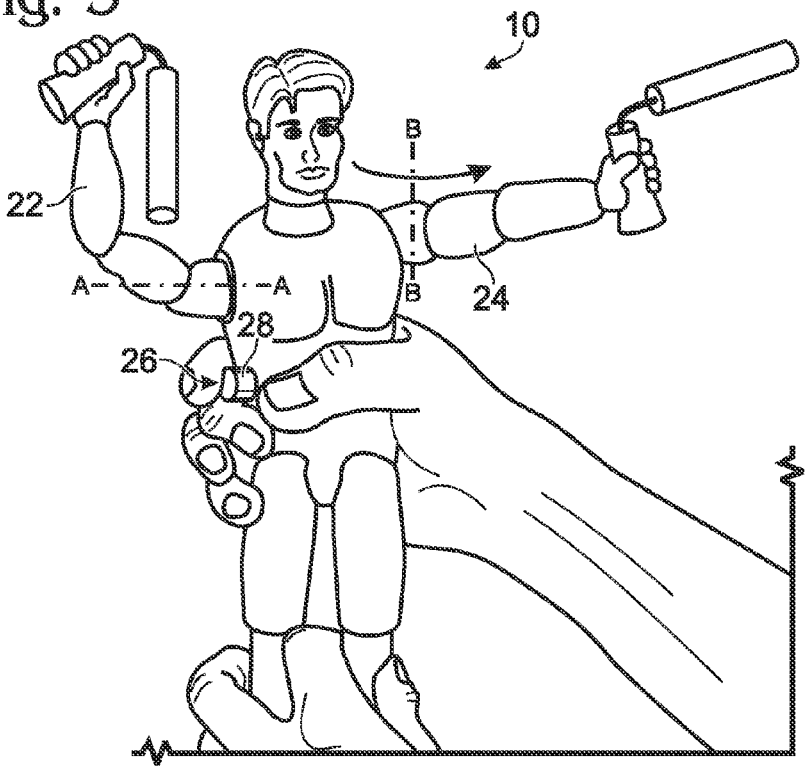
FIG. 3 illustrates the exemplary action figure of FIG. 2 showing movement of a second appendage about a second axis.
Figure 4:
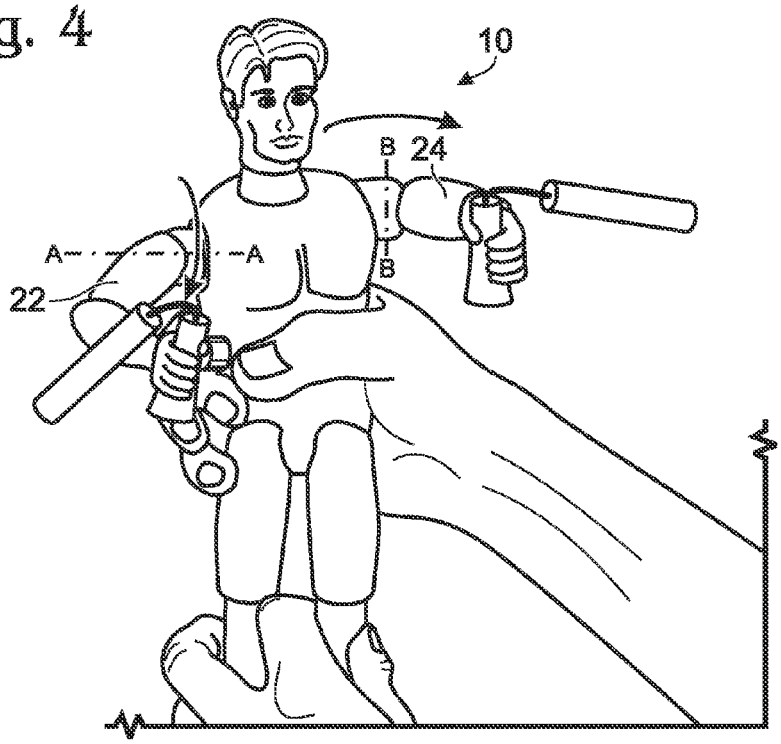
FIG. 4 illustrates the exemplary action figure of FIG. 3 showing return of the appendages to a neutral position.

FIGS. 2-4 illustrate movement of an exemplary toy. A shown, appendages 18 include a first arm 22 and a second arm 24 that move relative to torso 16. The first arm may move relative to a first axis, such as to rotate about a first axis A-A passing approximately through the shoulder joint of the first arm. The second arm may move relative to a second axis, such as to rotate about a second axis B-B passing approximately through the shoulder joint of the second arm. In some examples of toy 10, the appendages may otherwise move relative to corresponding axes, such as to translate towards or away from a corresponding axis. The first and second axes may be oriented relative to one another in any desired manner, such as substantially perpendicularly.

Toy 10 and/or accessory 100 may include one or more movable portions. For example, the illustrated weapon may be configured to move relative to the action figure to simulate use of a martial arts weapon. The accessory may be manipulated by either the action figure or a portion of the accessory itself. For example, a user input device 26 may be manipulated to move the accessory and/or body segments. In the exemplary toy of FIGS. 2-4, the user input device takes the form of a button 28 positioned on the side of the action figure that may be pressed to trigger movement of the arms of the figure and/or movement of the weapon components. For example, when the button is pressed, the figure's arms may move to swing the numchucks.

The arms may move simultaneously or there may be an offset or time delay between movement of the arms, as illustrated in FIGS. 2-4. As shown in FIG. 2, the toy's right arm is first raised upon pressing of button 28. As the button is released, the left arm is rotated sideways away from the torso, as shown in FIG. 3. The arms then return to the neutral position as illustrated in FIG. 4.

Figure 5:
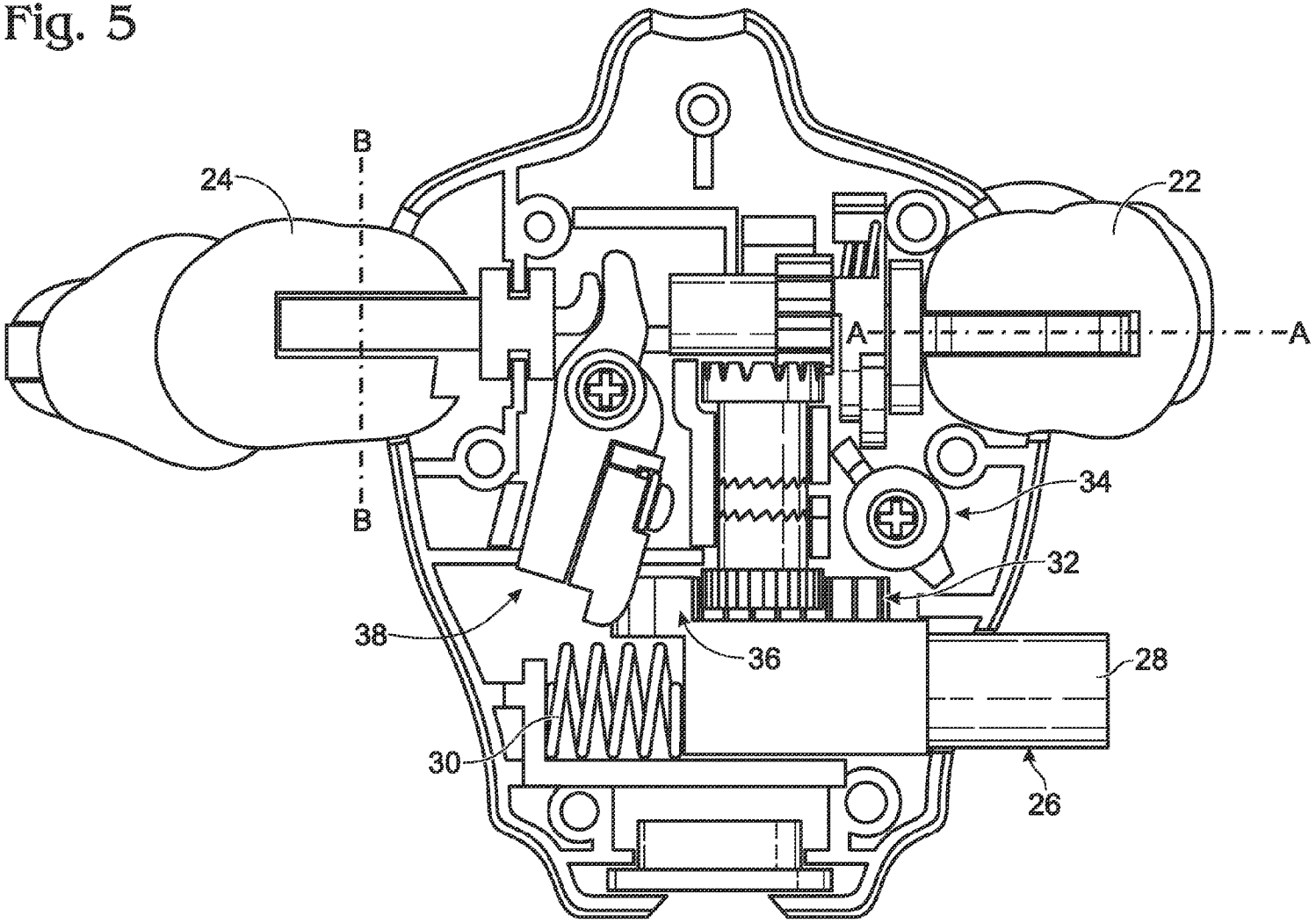
FIG. 5 illustrates internal components of an exemplary action figure.
Figure 6:
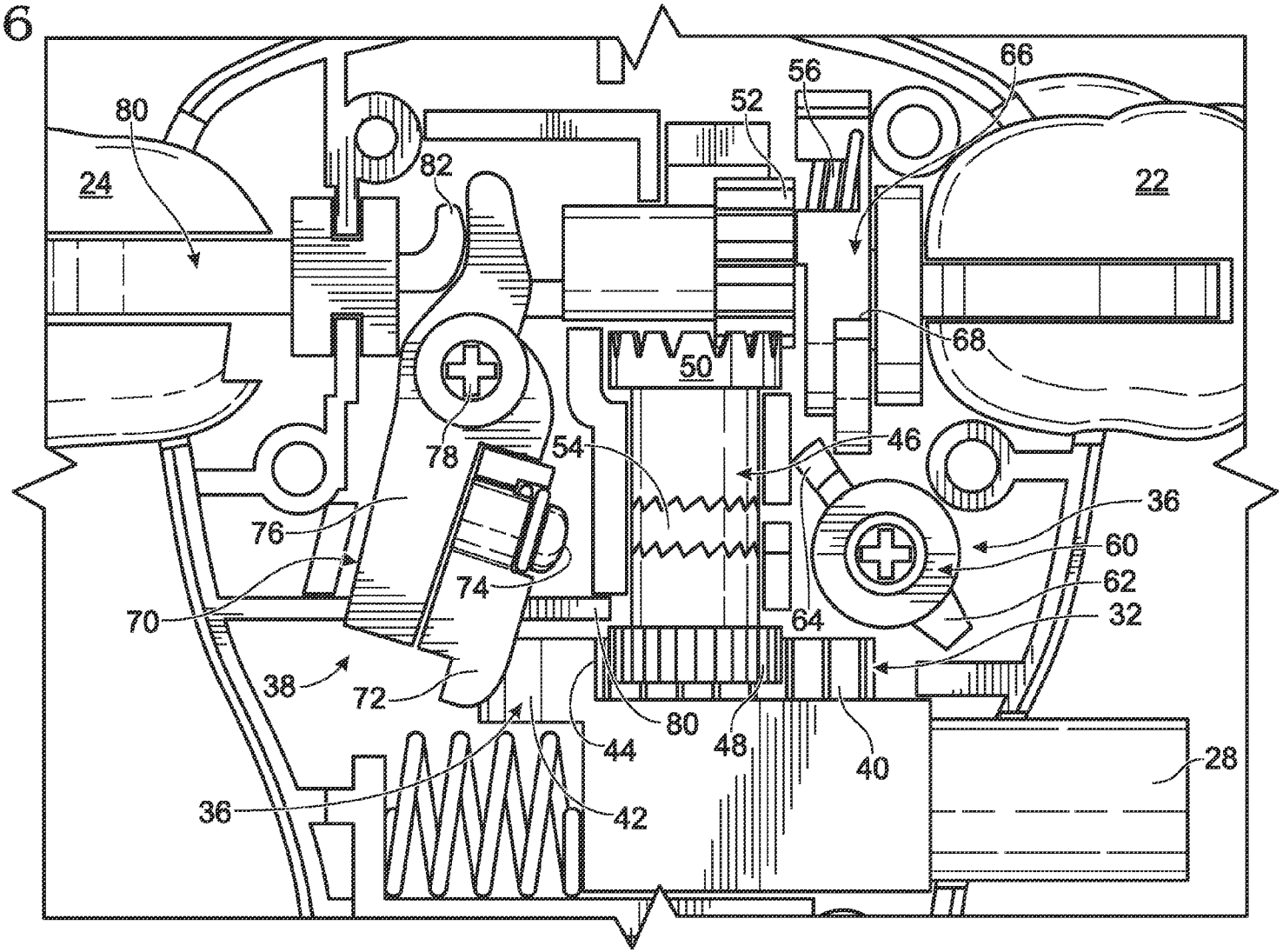
FIG. 6 illustrates further details of the internal components of FIG. 5.

Toy 10 may include a motor and/or gears, springs and other mechanical and/or electrical components suitable for providing the desired motion of the toy segments. FIGS. 5 and 6 illustrate internal components of an exemplary action figure as viewed from the back of the toy. As shown in FIG. 5, button 28 is biased toward an unactuated, or "at-rest," position by a spring 30. The button is integrally formed with a first actuation member 32 for actuating movement of first arm 22 via a first movement assembly 34 and a second actuation member 36 for actuating movement of second arm 24 via a second movement assembly 38. The first and second actuation members may be integrally formed with the user input device or may be coupled to the user input device using any suitable method.

The first and/or second movement assemblies may be configured to offset, interrupt, and/or delay various motions, such as to increase the complexity of the overall motion of the toy. Movement of one or more of the appendages may be delayed relative to actuation of the user input device, movement of the appendages may be offset from one another, or movement of one or more of the appendages may be temporarily interrupted during various stages of movement. For example as shown in FIGS. 2-4, when a user presses and releases the button, the right arm rotates in a single direction about axis B-B, the left arm then rotates in a single direction about axis A-A, momentarily "interrupting" the movement of the right arm, and then the right and left arms both return to their neutral positions.

As shown in FIG. 6, button 28 includes a first actuation member 32 and a second actuation member 36. The first actuation member may include a toothed portion 40, such as a rack or toothed bar, that engages the first movement assembly. The second actuation member may include an angled region 42 and a lip 44 that engage the second movement assembly.

First movement assembly 34 includes a gear cylinder 46 to transfer movement of toothed portion 40 to the first arm. The gear cylinder includes a gear 48 that engages the toothed portion. Therefore, as the button moves, the toothed portion moves, such as by sliding laterally, to rotate the gear cylinder. The opposing end of the gear cylinder includes a crown gear 50 that engages a gear 52 to rotate the first arm. The first movement assembly may include a clutch 54, such as along gear cylinder 46. For example, if button 28 is actuated when first arm 22 is not free to move, clutch 54 may allow the portions of gear cylinder 46 to rotate relative to one another to prevent damage to the first movement mechanism. The first movement assembly may include a spring 56 to bias the arm to its neutral position or provide resistance against gear 52 for a more controlled-looking movement of arm 22, such as a snapping motion.

A delay mechanism 60 maintains the first arm in the actuated position (i.e., a raised position as shown in FIG. 2) until the button is released. In the example shown, delay mechanism 60 is mounted adjacent toothed portion 40. The delay mechanism may include opposing first and second extensions 62, 64 and be biased to a particular position, such as with extension 62 towards the toothed portion. When the button is pressed to slide the toothed portion, gear cylinder 46 rotates gear 52, which in turn rotates a first anchor 66 to raise arm 22. Protrusion 64 of the delay mechanism engages the anchor, such as at notch 68 to temporarily maintain the arm in a raised position. When the button is released, the toothed portion moves (rightward as shown in FIG. 5) to engage protrusion 62 and rotate the delay mechanism in the opposite direction (counterclockwise in FIG. 5) to disengage the anchor. The arm is returned to its neutral position by any suitable combination of reverse motion of gear cylinder 46 and/or bias from spring 56.

In the exemplary toy of FIG. 6, the second movement assembly includes a transfer assembly 70 to couple movement of button 28 to second arm 24. The transfer assembly includes a delay portion 72 that rotates about a first pivot 74 and a movement portion 76 that rotates about a second pivot 78. As button 28 is depressed, delay portion 72 slides along angled portion 42 and rotates about pivot 74 until the delay portion passes over lip 44. When button 28 is released, lip 44 urges the delay portion, and thereby movement portion 76, to rotate (counterclockwise as shown in FIG. 5). As transfer assembly 70 is rotated, the delay portion is urged to disengage with lip 44 by sliding along slanted edge 80 of the torso interior. Consequently, the delay portion forms a ratchet pawl. Rotation of movement portion 76 moves a rod 82 that is coupled to arm 24, thereby urging the arm to rotate away from the torso (as illustrated in FIG. 3). Arm 24 may include an anchor 84 to retain the arm within the torso and provide a support and/or pin to form axis B-B.

The toy and accessories may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances. The subject matter of the present invention includes all novel and non-obvious combinations and subcombinations of the various elements, features, functions and/or properties disclosed herein. Inventions embodied in various combinations and subcombinations of features, functions, elements, and/or properties may be claimed through presentation of claims in a subsequent application.

What is claimed is:

1. An action figure comprising:

a torso configured to support a plurality of appendages;

first and second appendages configured to rotate about corresponding first and second axes, respectively;

first and second movement assemblies each coupled to a corresponding appendage, and actuatable to independently rotate the corresponding appendage;

wherein at least one of the first and second movement assemblies is configured upon actuation to delay rotation of the corresponding appendage by temporarily preventing rotation of the appendage.

2. The action figure of claim 1, further comprising a user input device configured to actuate the first and second movement mechanisms and biased toward an unactuated position.

3. The action figure of claim 1, wherein the first and second movement assemblies are each configured upon actuation to delay rotation of a corresponding appendage.

4. The action figure of claim 3, wherein the first and second movement assemblies are configured to provide asynchronous delay of appendage movement.

5. The action figure of claim 3, wherein the first and second movement assemblies operate independently of one another.

6. The action figure of claim 1, wherein the first axis and the second axis are substantially perpendicular.

7. The action figure of claim 1, wherein at least one of the first and second movement assemblies includes a clutch.

8. A toy comprising:

a body including a torso and a plurality of appendages;

a first movement assembly configured to rotate a first appendage;

a second movement assembly configured to rotate a second appendage;

a delay means for temporally offsetting rotation of the first and second appendages; and a user input device configured to actuate the first and second movement assemblies.

9. The toy of claim 8, wherein the delay means engages with the user input device, thereby delaying actuation of one of the first and second movement assemblies by temporarily preventing actuation of the assembly.

10. The toy of claim 9, wherein the delay means includes a ratchet.

11. The toy of claim 8, wherein the delay means engages with one of the first and second movement assemblies and is configured to interrupt rotation of a corresponding appendage.

12. The toy of claim 8, wherein the first and second appendages are configured to rotate about nonparallel axes.

13. A toy comprising:

a body including a torso, a first appendage configured to move relative to a first axis, and a second appendage configured to move relative to a second axis;

a first movement assembly configured to drive movement of the first appendage and including a mechanism configured to interrupt movement of the first appendage;

a second movement assembly configured to drive movement of the second appendage; and a user input device configured to actuate the first and second movement assemblies.

14. The toy of claim 13, wherein the mechanism is disengaged by the user input device to resume movement of the first appendage.

15. The toy of claim 13, wherein the first and second movement assemblies operate independently of one another.

16. The toy of claim 13, wherein the second movement assembly includes a transfer assembly configured to delay movement of the second appendage relative to actuation of the second movement assembly.

17. The toy of claim 16, wherein the transfer assembly includes a ratchet pawl configured to temporarily engage with the user input device and drive movement of the second appendage upon return of the user input device to a neutral position.

18. The toy of claim 17, wherein the second appendage is mounted to the body by an anchor and the transfer assembly drives movement of the appendage by moving a rod that is parallel to the anchor.

19. The toy of claim 13, wherein the first and second appendages are biased to respective first and second neutral positions.

20. The toy of claim 13, wherein at least one of the first and second movement assemblies includes a clutch.

* * * * *